US005282322A

United States Patent [19]

Kasuya

[11] Patent Number: 5,282,322

[45] Date of Patent: Feb. 1, 1994

[54] SOLAR SANITARY DRYER

[76] Inventor: Shiro Kasuya, 4 Naka-Shinmachi, Gifu City, Japan

[21] Appl. No.: 924,110

[22] Filed: Aug. 3, 1992

[30] Foreign Application Priority Data

Aug. 5, 1991 [JP] Japan ..... 3-195489

[51] Int. Cl.[5] ..... F26B 19/00

[52] U.S. Cl. ..... 34/93; 34/92; 126/624; 383/68

[58] Field of Search ..... 34/93, 15, 16, 92, 68; 126/624, 589, 711; 383/68, 63, 901

[56] References Cited

U.S. PATENT DOCUMENTS

| | | | |
|---|---|---|---|
| 3,700,019 | 10/1972 | Robbins et al. | 383/68 |
| 4,686,960 | 8/1987 | Kleinwächter | 126/624 |
| 4,703,518 | 10/1987 | Ausnit | 383/68 |
| 4,871,264 | 10/1989 | Robbins, III et al. | 383/68 |

*Primary Examiner*—Henry A. Bennet
*Assistant Examiner*—Denise L. Gromada
*Attorney, Agent, or Firm*—D. Peter Hochberg; Mark Kusner; Michael Jaffe

[57] ABSTRACT

A solar sanitary dryer bag to be used for drying and exterminating tiny worms and insects existing in a mattress or the like, characterized by having an opening for vacuuming the bag and having a black layer therein for effectively absorbing the solar heat.

9 Claims, 3 Drawing Sheets

SOLAR SANITARY DRYER

BACKGROUND OF THE INVENTION

This invention relates to a solar dryer for mattresses, mats, comforters, quilts and the like this invention more particularly relates to a solar sanitary dryer that can exterminate tiny worms and insects such as lice and mites that commonly exist in mattresses, mats, comforters, quilts and the like, and which may be harmful to and/or cause diseases among the users.

Various techniques and devices have hitherto been proposed for solar drying and/or sanitizing mattresses, mats, comforters and/or quilts, such as a solar dryer comprising a black fabric bag. A comforter, for instance, is put in the bag, which is then placed in the sun to be heated to exterminate tiny worms and insects such as lice and mites which are often seen existing in comforters and the like.

However, when such a bag and a comforter therein are placed on a roof, for example, for solar sanitary drying, the solar heat will not be evenly distributed throughout the comforter, usually resulting in the outer portion of the comforter getting heated first, then after a while the middle portion of the comforter is heated to some extent, while the innermost portion of the comforter will remain cool. As a result, a large portion of the tiny worms and insects in the comforter will be able to gradually move to the cooler portions of the comforter and eventually survive the deadly heat near the surface of the comforter.

In addition, the stuffed material inside a comforter or the like is usually made very porous to give the comforter or the like a soft feeling and elasticity, as well as good thermal insulation. Therefore, it will take considerable time for all of the stuffed material to get heated high enough to exterminate tiny worms and insects therein, thus giving time to the worms and insects to evacuate safely to the cooler places, resulting in poor performance in the sanitation of the comforter or the like.

Accordingly, it is an object of the present invention to provide a solar sanitary dryer for mattresses, mats, comforters, quilts and the like that can more reliably and quickly exterminate all tiny worms and insects such as lice and mites which commonly exist therein.

SUMMARY OF THE INVENTION

The object may be achieved from practice of the present invention, one embodiment of which is a solar sanitary dryer comprising a sheet-like plastic bag whose one end is open as an ordinary bag and whose one side surface has a sealable opening which is used to suck out the inside air therethrough to vacuum said plastic bag, a black plastic sheet which is utilized to effectively absorb the solar heat, and a sealing roll and a sealing groove member which are used to seal said open part of said plastic bag.

Through said open part of the plastic bag, a mat, for example, is put into the bag. Said black plastic sheet may be attached over to the inside surface of the plastic bag. Said sealable opening is to be connected with the hose of a vacuum means such as an electric vacuum cleaner and a large portion of the air inside the plastic bag is sucked out so that the mat loses its volume greatly inside the plastic bag, resulting in reduced porosity and eventually reduced thermal insulation. As a result, the solar heat is greater and is more quickly distributed throughout the mat than without said vacuum treatment of the mat.

The solar sanitary dryer of the present invention with the mat therein is placed in the sun after its vacuuming treatment through said opening, for example, with an electric vacuum cleaner, and is left in the sun to be heated up, preferably being turned over once or more for a better distribution of the solar heat throughout the mat. All or a large portion of the tiny worms and insects such as lice and mites existing in the mat will be exterminated efficiently when the sun is out and the temperature is sufficiently hot.

BRIEF DESCRIPTION OF THE DRAWINGS AND TABLE

An understanding of this invention may be had from the detailed discussion which follows and from an examination of the table and the drawings in which:

TABLE 1 is showing the temperature measurements of test samples;

DETAILED DESCRIPTION OF THE EMBODIMENT

This invention is described in detail hereunder.

Figure 3:
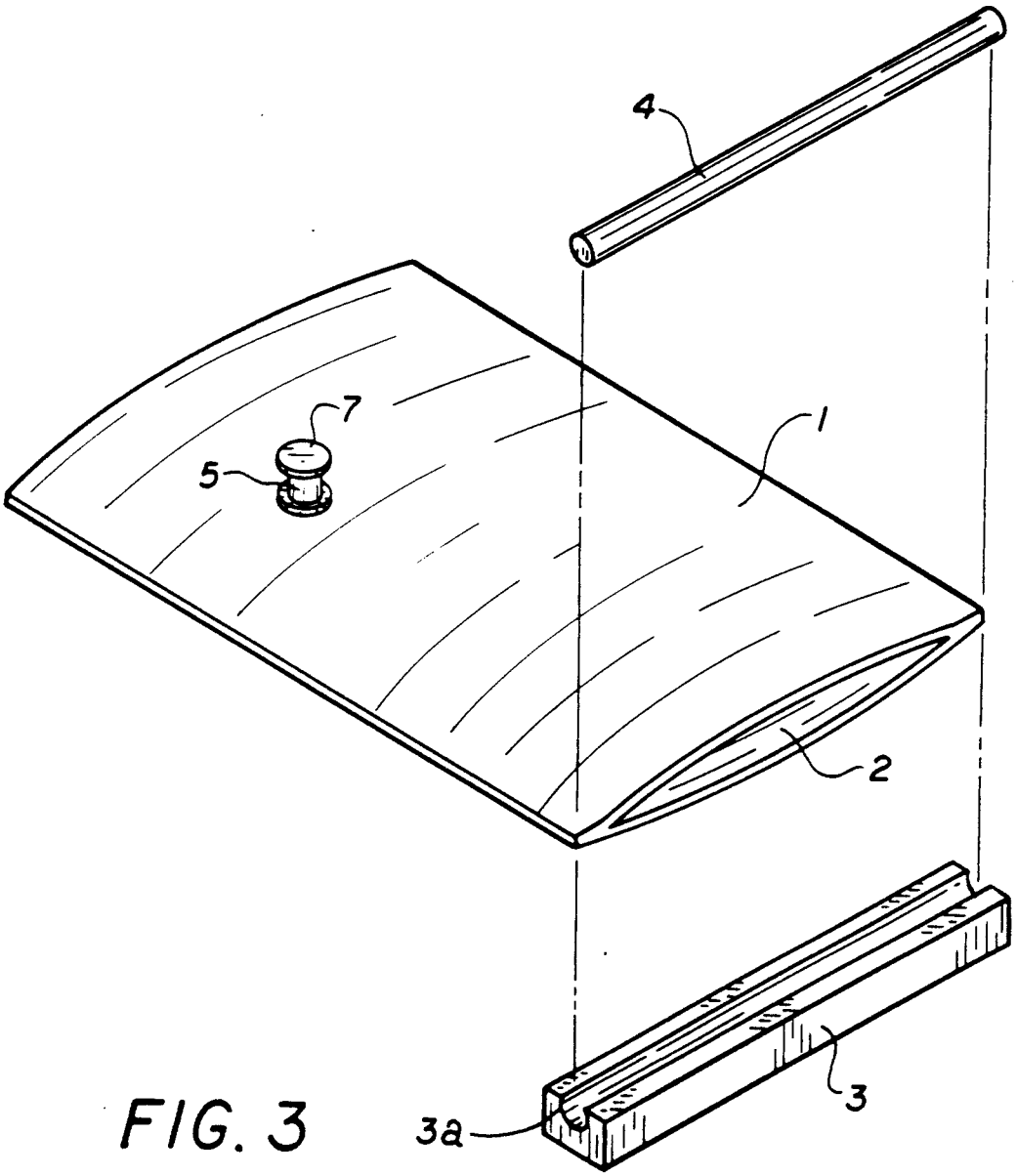
FIG. 3 is a perspective view of the solar sanitary dryer of the present invention together with a sealing roll and a sealing groove member.

As clearly shown in FIG. 3, a solar sanitary dryer of the present invention, Embodiment 1, chiefly comprises a substantially transparent and substantially rectangular plastic bag 1 with an open end part 2 used to put therefrom an article, such as a mattress, to be dried and sanitized into the bag 1. The plastic bag 1 need not be perfectly transparent or rectangular. The open part 2 is to be sealed using a sealing groove member 3 having a groove 3*a* longitudinally formed therein and a sealing roll 4 formed as such that the sealing roll 4 can press a traversing portion of said plastic bag 1 into said groove 3*a* and stay together therein so that the open part 2 can securely be sealed. Said sealing roll 4 and said sealing groove member 3 may be rubber or an elastic material. This sealing means can be anything as long as the sealing means can seal up the open part of the plastic bag securely.

On one side of the plastic bag 1 is an opening 5 having a sealing cap 7 and a one-way sealing valve 6. Said opening 5 is to be connected with the hose of a vacuum means such as a vacuum cleaner. Said one-way sealing valve 6 is a valve that prevents the air from getting into the plastic bag again once the bag 1 is vacuum treated. Said sealing cap 7 is used to help seal the opening 5.

Said transparent bag 1 has a sheet 8 attachedly covering all over the inner surface of the bag, which is preferably of a highly thermoconductive material such as aluminum or copper. Said sheet 8 may not be integrally formed on the inner surface of said plastic bag 1. Between said bag 1 and said sheet 8 therein is a thin black layer 9 of solar heat absorbing paint to help very effectively and efficiently absorb the solar heat coming through the transparent bag 1.

Said black layer 9 can be prepared by painting black lacquer over one side of said sheet 8 which is to come between said sheet 8 and said bag 1 or by painting same over the inner surface of said plastic bag 1. Said layer 9 can alternatively be prepared by using an ultrared radiation paint such as the ones manufactured by Okitsumo Co, Ltd., a Japanese company, under the product Nos. W-500 and W-600, or a black solar paint containing seramic powder such as the one manufactured by the same company under the product No. AP-1A.

The solar heat coming through said transparent bag 1 and absorbed in said layer 9 stays inside the bag better than the case in which only a black bag is used in place of said bag and said sheet with said layer, since the solar heat absorbed in said black layer is prevented by the bag covering the layer from escaping outside freely.

The following is an explanation of a method of drying and sanitizing a mattress or futon using a solar sanitary dryer of the present invention.

Figure 1:
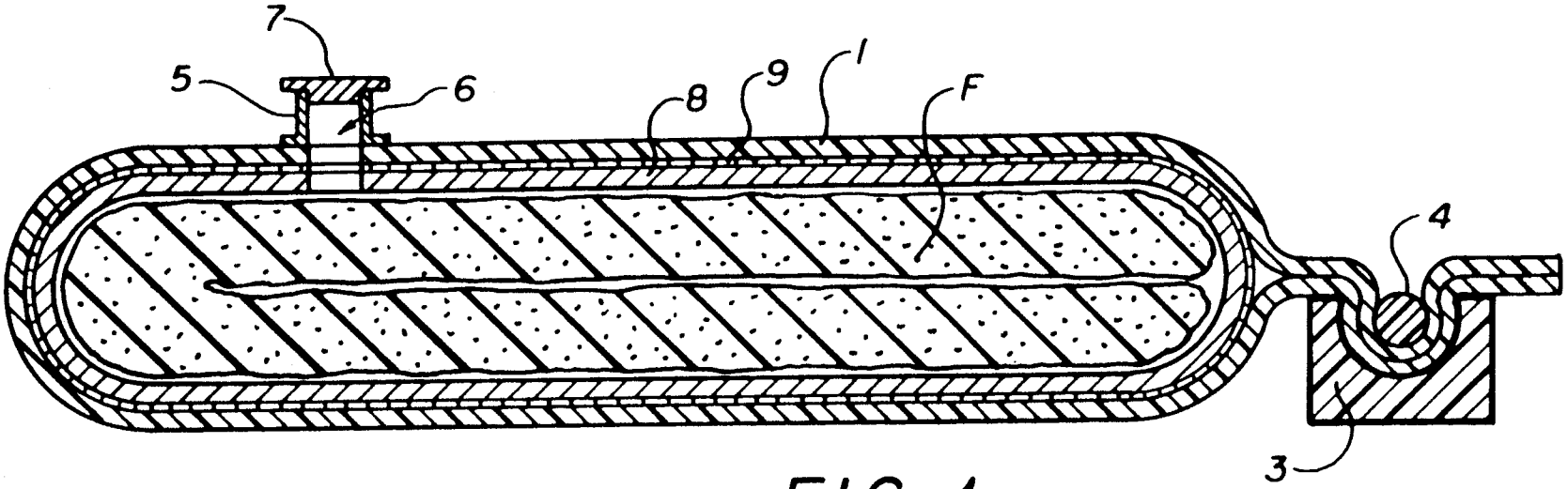
FIG. 1 is a sectional view of a solar sanitary dryer of the present invention cut longitudinally along said opening with a mattress folded in half and put therein.
Figure 2:
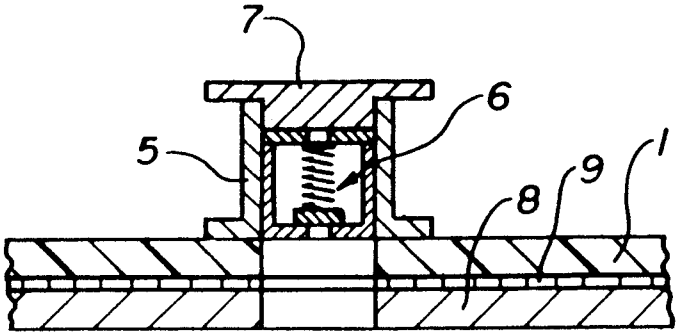
FIG. 2 is a partially enlarged sectional view of FIG. 1 showing the connecting means of the opening.

A mattress or futon (a Japanese equivalence of a mattress) F is foldedly put into bag 1 from said open part 2, which is then sealed by said sealing groove 3*a* of said sealing member 3 and said sealing roll 4 as shown in FIG. 1.

Said sealing cap 7 is removed from said opening 5 and the hose of a vacuum cleaner is connected with opening 5. Most of the air inside bag 1 is sucked out through opening 5 by the vacuum cleaner via the hose. Futon F then flattens and becomes much smaller in volume in bag 1 resulting in degradation the heat insulation function of the futon's inner material. After opening 5 is sealed back with cap 7, bag 1 with futon F therein is placed in the sun on a roof or a porch or wherever appropriate.

Figure 4:
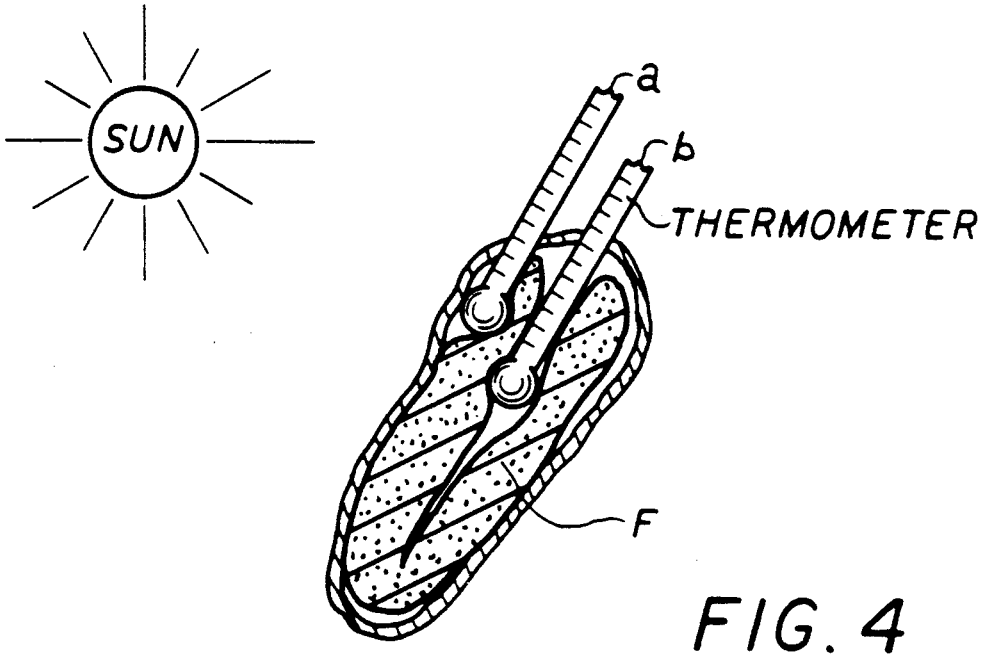
FIG. 4 is a schematic view of the plastic bag and a mattress therein showing a vacuumed state thereof.
Figure 5:
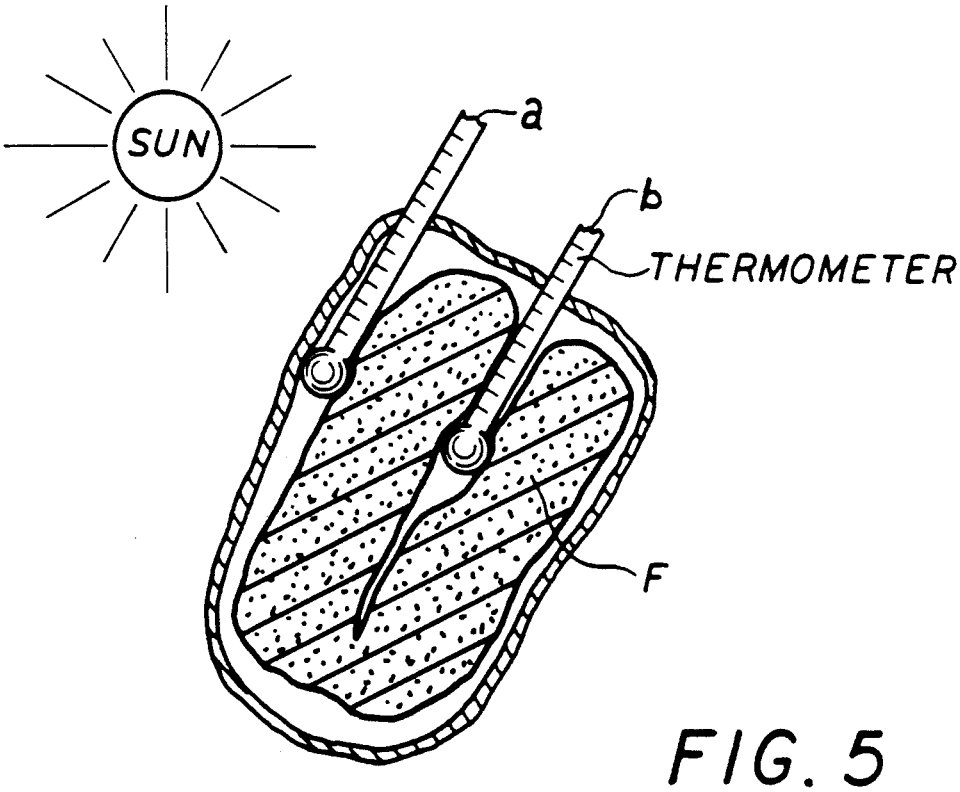
FIG. 5 is a schematic view of the plastic bag and a mattress therein showing a state without vacuuming.

In about 60 minutes, with an outdoor temperature of approximately 28° C., the temperature measured on the surface (a) of the futon as shown in FIGS. 4 and 5 becomes about 69° C. and the temperature measured approximately the center (b) of the futon as shown in FIGS. 4 and 5 becomes approximately 46° C. In about 120 minutes the temperatures become about 70° C. and 47° C. respectively as the solar heat is speedily distributed inside the futon from the surface, since the heat conductivity of the futon is considerably improved said vacuum treatment; these temperatures are all high enough to exterminate mites, for example, and therefore most of the tiny worms and insects likely existing in the futon will be exterminated effectively.

When futon F is being heated, it is necessary to repeat vacuuming of bag 1 at least a couple of times so that the moisture vaporized inside bag 1 is sucked out together with the remaining air, which increases its volume as it is heated, otherwise the moisture inside the bag will dampen back futon F. As need be, some outside air may be supplied into the bag and sucked out again together with the vaporized moisture. Repeated vacuuming of bag 1 better dries futon F and also helps the temperature in futon F to increase higher.

Also, it is preferable to turn over bag 1 during the solar heating at least once so that the solar heat coming from one side of the bag surface at a time is distributed more evenly throughout the futon.

It has been confirmed that all mites die within 24 hours under the temperature of 45.5° C. therefore, it is understood that most mites in futon F in the present embodiment will die more quickly than in 24 hours, as quickly as within 1 hour in the case of most mites near the surface of futon F and even most mites existing deep inside futon F will die within 2 hours because the temperature there will also go above 45.5° C. as Table 1 shows.

A few other embodiments of the present invention and comparation solar dryers are given below.

Another solar sanitary dryer of the present invention, Embodiment 2, uses just a black plastic sheet instead of the sheet 8 and the black layer 9 of Embodiment 1.

Still another solar sanitary dryer of the present invention, Embodiment 3, uses a radiant paint manufactured by Okitsumo Co., Ltd. under the product No. B-600 instead of the black lacquer 9 of Embodiment 1.

A solar dryer for comparison, Comparison 1, uses an aluminum sheet without any blackening treatment in place of the sheet 8 and the layer 9 of Embodiment 1, which is vacuum treated.

Another solar dryer for comparison, Comparison 2, uses only a black plastic bag in place of the transparent plastic bag 1, the sheet 8 and the black layer 9 of Embodiment 1, which is not vacuum treated.

All Embodiments 1, 2 and 3 and Comparisons 1 and 2 were tested under identical conditions (including the sample futon used in each test) with the outdoor temperature of 28.1° C. and the resulting temperatures measured at positions (a) and (b) in FIGS. 4 and 5 at fixed intervals were compared. Table 1 shows the results of the temperature measurements.

As Table 1 shows, in the cases of Comparisons 1 and 2, the temperatures inside futon F (b) in both cases did not go high enough in four test hours to exterminate the mites there.

On the contrary, as for Embodiments 1 to 3, the temperatures inside futon F (b) all increased high enough to exterminate most of the mites there.

From the results of the tests, it is understood that the solar sanitary dryers according to the present invention can effectively exterminate tiny worms and insects such as lice and mites in mattresses, mats, comforters, etc. not only from their surface portions but also from their inner portions, thus effectively sanitizing the mattresses, mats, comforters, etc., contributing to the health of the users.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalences of the claims are therefore intended to be embraced therein.

TABLE 1

| Samples | Time | | | | | | | |
|---|---|---|---|---|---|---|---|---|
| | 30 min. | | 60 min. | | 120 min. | | 240 min. | |
| | Temp. | | | | | | | |
| | Surface °C. | Inside °C. | Surface °C. | Inside °C. | Surface °C. | Inside °C. | Surface °C. | Inside °C. |
| Embodiment 1 | 68.0 | 42.5 | 69.0 | 45.5 | 89.5 | 47.0 | 64.0 | 49.0 |
| Embodiment 2 | 68.0 | 42.0 | 89.0 | 45.0 | 66.5 | 45.5 | 59.0 | 47.0 |
| Embodiment 3 | 69.0 | 41.0 | 65.0 | 48.0 | — | — | — | — |
| Comparison 1 | — | 30.0 | — | 31.0 | — | 34.0 | — | — |
| Comparison 2 | 42.5 | 29.0 | 44.0 | 31.0 | 41.0 | 33.5 | 51.0 | 38.0 |

What is claimed is:

1. A solar sanitary dryer to be used for drying a mattress, a mat, a comforter, or a quilt, and for exterminating tiny worms and insects existing therein, including:

a substantially transparent plastic bag having thereon a first opening for inserting said mattress, mat, comforter or quilt into said bag, a second opening for vacuuming air out of the bag to reduce the volume of said bag and to increase heat conductivity within said bag, and exterminating means in said dryer, said extermination means comprising heat absorbing black layer means disposed adjacent said bag for increasing the heat inside said bag to exterminate worms and insects.

2. A solar sanitary dryer according to claim 1, further comprising a sheet for conducting heat throughout said bag; said sheet put inside said bag such that said heat absorbing black layer means is disposed between said bag and said sheet.

3. A solar sanitary dryer according to claim 1 further comprising a sealing means for sealing said first opening.

4. A solar sanitary dryer according to claim 1, wherein said bag has a one-way sealing valve for sealing said second opening.

5. A solar sanitary dryer, according to claim 3, wherein said sealing means comprises:

a sealing groove member having a longitudinally formed groove therein, and a sealing roll for engaging the groove and sealing said first opening.

6. A solar sanitary dryer according to claim 1, wherein said heat absorbing black layer means is comprised of a solar heat absorbing paint.

7. A solar sanitary dryer according to claim 2, wherein said sheet is comprised of thermoconductive material.

8. A solar sanitary dryer according to claim 7 wherein said thermoconductive material is aluminum.

9. A solar sanitary dryer according to claim 7 wherein said thermoconductive material is copper.

* * * * *